US011813874B2

(12) United States Patent
Kubo et al.

(10) Patent No.: US 11,813,874 B2
(45) Date of Patent: Nov. 14, 2023

(54) PROCESS CARTRIDGE AND IMAGE FORMING APPARATUS INCORPORATING SAME

(71) Applicants: Tatsuya Kubo, Kanagawa (JP); Shinya Karasawa, Kanagawa (JP); Kazuki Yogosawa, Tokyo (JP); Yuuki Tsuchiya, Kanagawa (JP)

(72) Inventors: Tatsuya Kubo, Kanagawa (JP); Shinya Karasawa, Kanagawa (JP); Kazuki Yogosawa, Tokyo (JP); Yuuki Tsuchiya, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/467,468

(22) Filed: Sep. 7, 2021

(65) Prior Publication Data

US 2022/0072862 A1 Mar. 10, 2022

(30) Foreign Application Priority Data

Sep. 10, 2020 (JP) ..... 2020-152322

(51) Int. Cl.
*B41J 2/175* (2006.01)

(52) U.S. Cl.
CPC ..... *B41J 2/1752* (2013.01); *B41J 2/17553* (2013.01)

(58) Field of Classification Search
CPC .. B41J 2/1752; B41J 2/17553; G03G 15/0813
USPC ..... 347/86
See application file for complete search history.

(56) References Cited

U.S. PATENT DOCUMENTS

2003/0049054 A1* 3/2003 Ozawa ..... G03G 15/0808 399/272
2005/0191089 A1* 9/2005 Nishimura ..... G03G 21/1825 399/111
2021/0080856 A1 3/2021 Hashikawa et al.

FOREIGN PATENT DOCUMENTS

JP 10-293518 11/1998
JP 2014-139654 7/2014

* cited by examiner

*Primary Examiner* — Matthew Luu
*Assistant Examiner* — Alexander D Shenderov
(74) *Attorney, Agent, or Firm* — XSENSUS LLP

(57) ABSTRACT

A process cartridge includes an image bearer, a developer bearer, and a positioning member. The image bearer is rotatable. The developer bearer is rotatable and opposite to the image bearer. The positioning member determines an opposing distance between the image bearer and the developer bearer, and includes a fitting portion and a groove. A fitted portion of the image bearer rotatably fits to the fitting portion. The groove extends from a ceiling portion to a bottom portion. A shaft portion of the developer bearer is slidingly movable in the groove. The groove is formed such that the shaft portion of the developer bearer contacts the bottom portion and is supported by the bottom portion. The ceiling portion of the groove is open upward so that the shaft portion of the developer bearer is insertable to and removable from the groove.

19 Claims, 5 Drawing Sheets

PROCESS CARTRIDGE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2020-152322, filed on Sep. 10, 2020, in the Japan Patent Office, the entire disclosure of which is incorporated by reference herein.

BACKGROUND

Technical Field

Embodiments of the present disclosure generally relate to a process cartridge which is detachably installed in a main body of an image forming apparatus, and an image forming apparatus such as a copier, a printer, a facsimile machine, or a multifunction peripheral (MFP) having at least two functions of copying, printing, and facsimile transmission, and incorporating the process cartridge.

Related Art

Conventionally, in a process cartridge disposed in an image forming apparatus such as a copying machine or a printer, there is known a technique that the process cartridge includes a face plate (positioning member) to fit a shaft portion of a developing roller and a shaft portion of a photoconductor drum for the purpose of setting a gap (opposing distance) between the developing roller (developer bearer) and the photoconductor drum (image bearer) with high accuracy. Specifically, the face plate (positioning member) is formed with a through-hole that fits into a shaft portion of the developing roller of a developing device and a through-hole that fits into a shaft portion of the photoconductor drum. The shaft portion of the developing roller and the shaft portion of the photoconductor drum are fitted into the two through-holes of the face plate. The interaxial distance between the developing roller and the photoconductor drum is determined. As a result, the gap between the developing roller and the photoconductor drum is set with high accuracy.

SUMMARY

In an aspect of the present disclosure, there is provided a process cartridge that includes an image bearer, a developer bearer, and a positioning member. The image bearer is rotatable. The developer bearer is rotatable and opposite to the image bearer. The positioning member determines an opposing distance between the image bearer and the developer bearer, and includes a fitting portion and a groove. A fitted portion of the image bearer rotatably fits to the fitting portion. The groove extends from a ceiling portion to a bottom portion. A shaft portion of the developer bearer is slidingly movable in the groove. The groove is formed such that the shaft portion of the developer bearer contacts the bottom portion and is supported by the bottom portion. The ceiling portion of the groove is open upward so that the shaft portion of the developer bearer is insertable to and removable from the groove.

In another aspect of the present disclosure, there is provided an image forming apparatus that includes a main body and the process cartridge. The process cartridge is detachably attached with respect to the main body.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
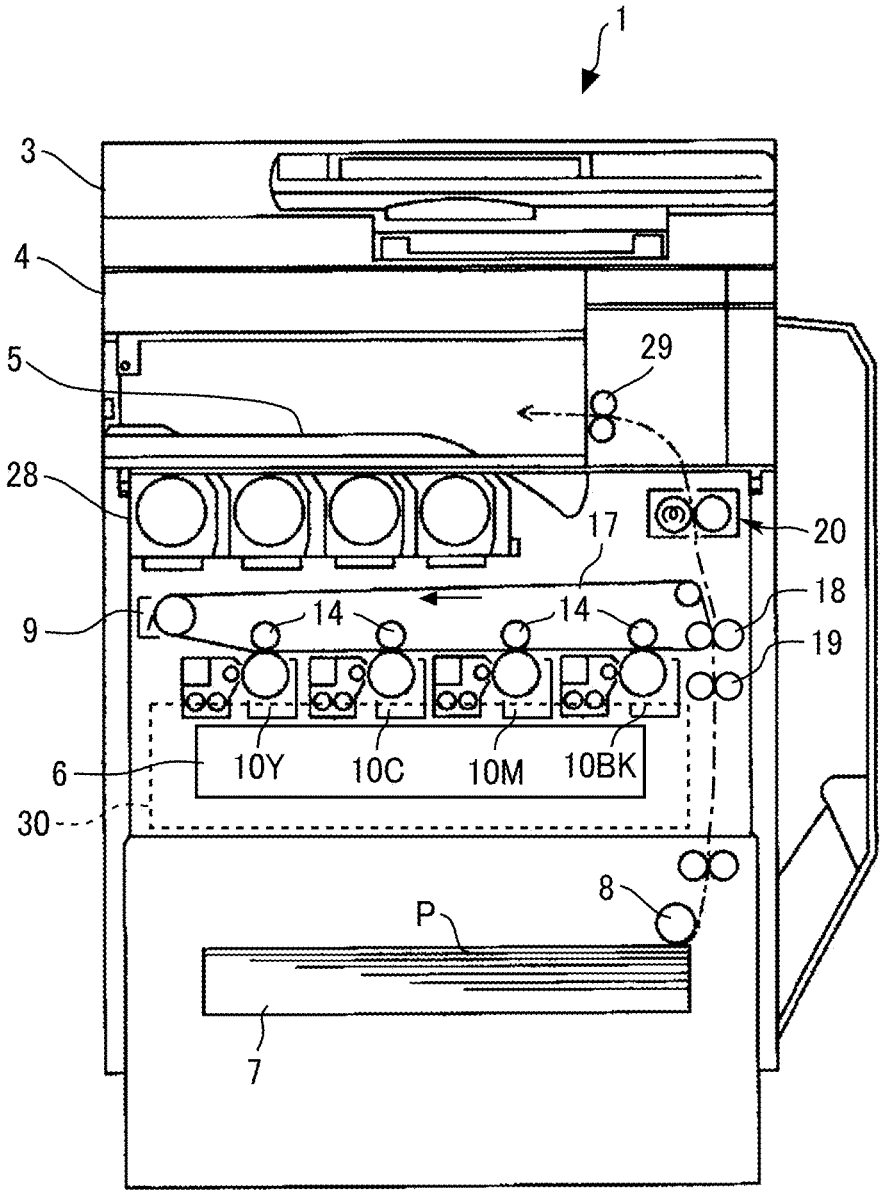
FIG. 1 is a schematic diagram illustrating an overall configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

An overall configuration and operation of an image forming apparatus 1 according to an embodiment of the present disclosure are described below with reference to FIG. 1. In FIG. 1, the image forming apparatus 1, which is illustrated as a color copier in the present embodiment, includes a document conveyance device 3, a scanner 4 (document reading device), and a writing device 6 (exposure device).

The document conveyance device 3 conveys documents to the scanner 4. The scanner 4 scans image data for the documents. The writing device 6 emits a laser beam based on input image data. The image forming apparatus 1 also includes a sheet feeder 7, process cartridges 10Y, 10M, 10C, and 10BK, an intermediate transfer belt 17, and a secondary transfer roller 18. The sheet feeder 7 accommodates sheets of paper P or the like. The process cartridges 10Y, 10M, 10C, and 10BK are image forming devices to form yellow, magenta, cyan, and black toner images, respectively. The intermediate transfer belt 17 onto which the toner images of multiple colors are transferred and superimposed. The secondary transfer roller 18 transfers the toner images on the intermediate transfer belt 17 onto the sheet P. The image forming apparatus 1 further includes a fixing device 20, toner containers 28, and a waste-toner container 30. The waste-toner is collected in the waste-toner container 30. The fixing device 20 fixes unfixed toner images on the sheet P. The toner containers 28 contain toners of respective colors to be supplied to developing devices 13 of the corresponding process cartridges 10Y, 10M, 10C, and 10BK.

Figure 2:
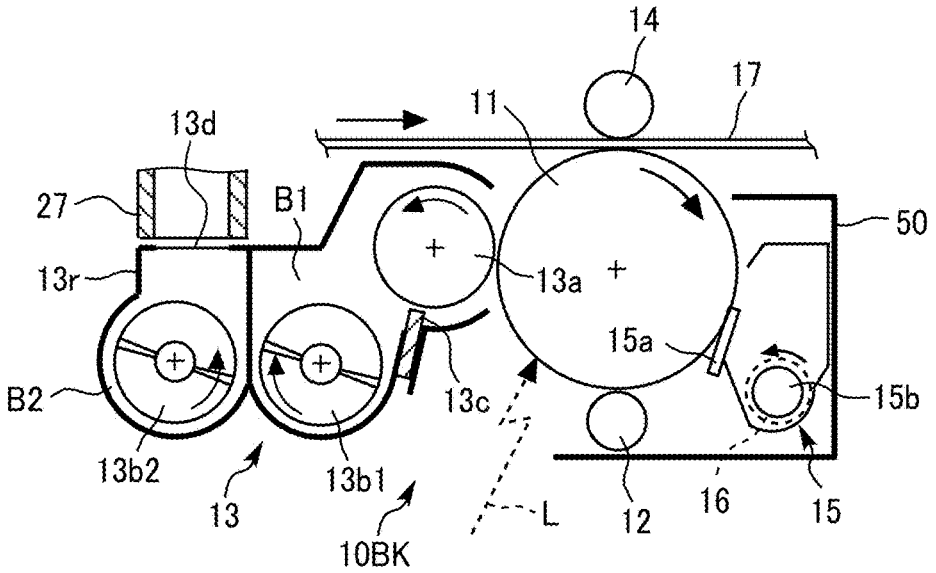
FIG. 2 is a schematic diagram illustrating a configuration of an image forming device of the image forming apparatus in FIG. 1.

Each of the process cartridges 10Y, 10M, 10C, and 10BK (serving as image forming devices) includes a photoconductor drum 11 (serving as an image bearer), a charging device 12, the developing device 13, and a cleaning device 15, which are integrated as a single unit as illustrated in FIG. 2. Each of the process cartridges 10Y, 10M, 10C, and 10BK, which is expendable, is replaced with a new one when depleted. Yellow, magenta, cyan, and black toner images are formed on the respective photoconductor drums 11 (serving as image bearers) in the process cartridges 10Y, 10M, 10C, and 10BK.

A description is provided below of the operation of the image forming apparatus 1 to form a normal color image. A conveyance roller of the document conveyance device 3 conveys a document on a document table onto an exposure glass of the scanner 4. The scanner 4 optically scans image data from the document on the exposure glass. The yellow, magenta, cyan, and black image data are transmitted to the writing device 6. The writing device 6 irradiates the photoconductor drums 11 of the corresponding process cartridges 10Y, 10M, 10C, and 10BK with laser beams (exposure light) L based on the yellow, magenta, cyan, and black image data, respectively.

Each of the four photoconductor drums 11 rotates clockwise in FIGS. 1 and 2. With reference to FIG. 2, the charging device 12 (e.g., charging roller 12*a*) uniformly charges a surface of the photoconductor drum 11 at a position opposite the photoconductor drum 11 (charging process). Thus, the surface of the photoconductor drum 11 is charged to a certain potential. Subsequently, the surface of the photoconductor drum 11 thus charged reaches a position where the surface of the photoconductor drum 11 is irradiated with the laser beam L. The writing device 6 emits the laser beams L for respective colors from a light source according to the image data. The laser beams L are reflected by a polygon mirror and transmitted through multiple lenses. The transmitted laser beams L pass through different optical paths for the different color components of yellow, magenta, cyan, and black (exposure process).

The laser beam L corresponding to the yellow image data is irradiated to the surface of photoconductor drum 11 in the process cartridge 10Y, which is the first from the left in FIG. 1 among the four process cartridges 10Y, 10M, 10C, and 10BK. Thus, an electrostatic latent image for yellow is formed on the photoconductor drum 11 charged by the charging roller 12*a*. Similarly, the laser beam L corresponding to the cyan image data is irradiated to the surface of the photoconductor drum 11 in the process cartridge 10C, which is the second from the left in FIG. 1 among the four process cartridges 10Y, 10M, 10C, and 10BK, thus forming an electrostatic latent image for cyan on the surface of the photoconductor drum 11. The laser beam L corresponding to the magenta image data is irradiated to the surface of the photoconductor drum 11 in the process cartridge 10M, which is the third from the left in FIG. 1 among the four process cartridges 10Y, 10M, 10C, and 10BK, thus forming an electrostatic latent image for magenta on the surface of the photoconductor drum 11. The laser beam L corresponding to the black image data is irradiated to the surface of the photoconductor drum 11 in the process cartridge 10BK, which is the fourth from the left in FIG. 1 among the four process cartridges 10Y, 10M, 10C, and 10BK, thus forming an electrostatic latent image for black on the surface of the photoconductor drum 11.

Then, the surface of the photoconductor drum 11 having the electrostatic latent image reaches a position opposite the developing device 13 (see FIG. 2). The developing device 13 supplies toner of each color onto the surface of the photoconductor drum 11 and develops the electrostatic latent image on the photoconductor drum 11 into a toner image (development process). Subsequently, the surface of the photoconductor drum 11 after the development process reaches a position opposite the intermediate transfer belt 17 (intermediate transferor) as image bearer. Primary transfer rollers 14 are disposed at the positions where the photoconductor drums 11 face the intermediate transfer belt 17 and in contact with an inner circumferential surface of the intermediate transfer belt 17. At the positions of the primary transfer rollers 14, the toner images on the photoconductor drums 11 are transferred to and superimposed on the intermediate transfer belt 17, forming a multicolor toner image thereon (primary transfer process).

After the primary transfer process, the surface of the photoconductor drum 11 reaches a position opposite the cleaning device 15 (see FIG. 2). The cleaning device 15 collects untransferred toner remaining on the photoconductor drum 11 (cleaning process). The untransferred toner collected in the cleaning device 15 is conveyed in a conveyance tube 16 by the conveying screw 15*b* (see FIG. 2) and is collected as waste toner in the waste-toner container 30. Then, the surface of the photoconductor drum 11 passes through a discharger to complete a series of image forming processes performed on the photoconductor drum 11.

On the other hand, the surface of the intermediate transfer belt 17, onto which the single-color toner images on the photoconductor drums 11 are superimposed, moves in the direction indicated by arrow in FIG. 1 and reaches a position opposite the secondary transfer roller 18. The secondary transfer roller 18 secondarily transfers the multicolor toner image on the intermediate transfer belt 17 to the sheet P (secondary transfer process). After the secondary transfer process, the surface of the intermediate transfer belt 17 reaches a position opposite an intermediate transfer belt cleaner 9 (cleaning device). The intermediate transfer belt cleaner 9 collects untransferred toner on the intermediate transfer belt 17 to complete a series of transfer processes on the intermediate transfer belt 17. The untransferred toner collected in the intermediate transfer belt cleaner 9 is conveyed in the conveyance tube 16 by the conveying screw 15*b* (see FIG. 3) and is collected as waste toner in the waste-toner container 30.

The sheet P is conveyed from the sheet feeder 7 to the position of the secondary transfer roller 18, via a sheet conveyance guide, a registration roller pair 19, and the like. More specifically, a feed roller 8 feeds a sheet P from the sheet feeder 7 that accommodates a stack of sheets P, and the sheet P is then guided by the sheet conveyance guide to the registration roller pair 19. The sheet P that has reached the registration roller pair 19 is conveyed toward the position of the secondary transfer roller 18, timed to coincide with the arrival of the multicolor toner image on the intermediate transfer belt 17.

Subsequently, the sheet P, onto which the multicolor image is transferred, is conveyed to the fixing device 20. The fixing device 20 includes a fixing roller and a pressure roller pressing against each other. In a nip between the fixing roller and the pressure roller, the multicolor toner image is fixed on the sheet P. After the fixing process, an output roller pair 29 ejects the sheet P as an output image to the exterior of a main body of the image forming apparatus 1, and the ejected sheet P is stacked on an output tray 5 to complete a series of image forming processes.

Next, with reference to FIGS. 2 and 3, the image forming devices of the image forming apparatus according to the present embodiment are described in detail below. FIG. 2 is a schematic view of the process cartridge 10BK for black. Other three process cartridges 10Y, 10M, and 10C have a similar configuration to that of the process cartridge 10BK for black except for the color of toner used in the image forming process, and thus drawings and descriptions thereof are omitted to avoid redundancy.

As illustrated in FIG. 2, the process cartridge 10BK mainly includes the photoconductor drum 11 as the image bearer, the developing device 13, the charging device 12, and the cleaning device 15, which are stored in a cartridge casing 50 (housing) as a single unit. The cleaning device 15 includes a cleaning blade 15*a* and a conveying screw 15*b* that contact the photoconductor drum 11.

The developing device 13 mainly includes a developing roller 13*a* (serving as a developer bearer) that forms a developing area opposing the photoconductor drum 11, a first conveying screw 13*b*1 (serving as a first conveyor) disposed opposite the developing roller 13*a*, a partition 13*e*, a second conveying screw 13*b*2 (serving as a second conveyor) disposed opposite the first conveying screw 13*b*1 via the partition 13*e*, and a doctor blade 13*c* (serving as a developer regulator) disposed opposite the developing roller 13*a* to regulate the amount of developer borne on the developing roller 13*a*.

The developing device 13 stores a two-component developer including carrier and toner. The developing roller 13*a* is opposed to the photoconductor drum 11 with a small gap H as illustrated in FIG. 3, thereby forming a developing area. As illustrated in FIG. 3, the developing roller 13*a* includes magnets 13*a*1 disposed inside and a sleeve 13*a*2 that rotates around the magnets 13*a*1. The magnets 13*a*1 generate multiple poles (magnetic poles) around the outer circumferential surface of the developing roller 13*a*.

Figure 3:
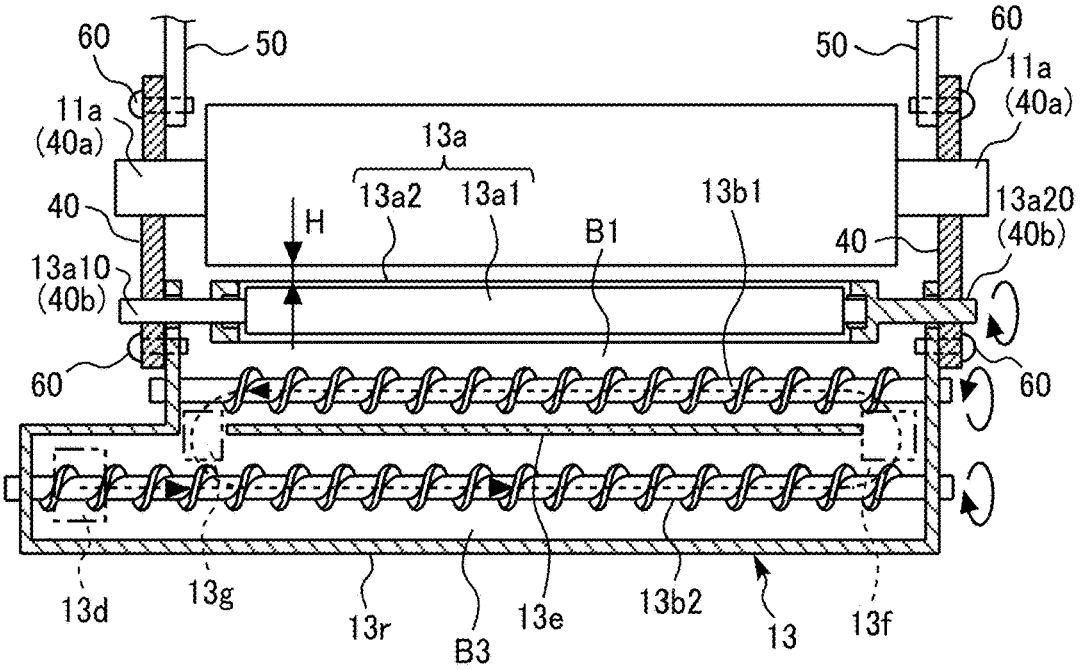
FIG. 3 is a cross-sectional view of a main part of a process cartridge according to an embodiment of the present disclosure, cut along a longitudinal direction of the process cartridge.

The conveying screws 13*b*1 and 13*b*2 (serving as conveyors) convey the developer stored in the developing device 13 in the longitudinal direction of the developing device 13, thereby forming a circulation path indicated by the dashed arrow in FIG. 3. That is, the circulation path of the developer includes a first conveyance path B1 with the first conveying screw 13*b*1 and a second conveyance path B2 with the second conveying screw 13*b*2. The partition 13*e* (serving as a wall portion) separates the first conveyance path B1 from the second conveyance path B2. The first conveyance path B1 and the second conveyance path B2 communicate with each other at both longitudinal ends thereof via a first communication opening 13*f* and a second communication opening 13*g*. Specifically, in the conveyance direction of the developer with reference to FIG. 3, an upstream end of the first conveyance path B1 communicates with a downstream end of the second conveyance path B2 via the first communication opening 13*f* Additionally, in the conveyance direction of the developer with reference to FIG. 3, a downstream end of the first conveyance path B1 communicates with an upstream end of the second conveyance path B2 via the second communication opening 13*g*. That is, the partition 13*e* is disposed along the circulation path except both longitudinal ends of the circulation path. The first conveying screw 13*b*1 in the first conveyance path B1 is disposed opposite the developing roller 13*a*. The second conveying screw 13*b*2 in the second conveyance path B2 is disposed opposite the first conveying screw 13*b*1 in the first conveyance path B1 via the partition 13*e*. The first conveying screw 13*b*1 supplies developer to the developing roller 13*a* and collects the developer separated from the developing roller 13*a* after the development process while conveying the developer in the longitudinal direction of the developing device 13. The second conveying screw 13*b*2 stirs and mixes the developer after the development process conveyed from the first conveyance path B1 with a fresh toner supplied from a toner supply inlet 13*d* while conveying the developer and the fresh toner in the longitudinal direction of the developing device 13. In the present embodiment, the first conveying screw 13*b*1 and the second conveying screw 13*b*2 as the conveyors are horizontally arranged in parallel. Each of the first conveying screw 13*b*1 and the second conveying screw 13*b*2 includes a shaft and a screw blade wound around the shaft.

The image forming processes, described above, are described focusing on the development process in further detail below with reference to FIGS. 2 and 3. The developing roller 13*a* rotates in the direction indicated by an arrow in FIG. 2. As illustrated in FIGS. 2 and 3, the first conveying screw 13*b*1 and the second conveying screw 13*b*2 are disposed facing each other with the partition 13*e* interposed therebetween and rotate in directions indicated by arrows in FIGS. 2 and 3. Toner is supplied from the toner container 70 to the toner supply inlet 13*d* (serving as an inlet opening) via a toner supply path 27. As the first conveying screw 13*b*1 and the second conveying screw 13*b*2 rotate in the respective directions in FIG. 2, the developer stored in the developing device 13 circulates together with the supplied toner in the longitudinal direction of the developing device 13 (the direction indicated by the dashed arrow in FIG. 3) while being stirred and mixed with the supplied toner. The toner supply inlet 13*d* of the developing device 13 communicates with and is released from the toner supply path 27 of the main body of the image forming apparatus 1 in conjunction with the attachment or detachment operation of the developing device 13 (in other words, the process cartridge 10BK) with respect to the main body of the image forming apparatus 1.

The toner is charged by friction with carrier in the developer and electrostatically attracted to carrier. Then, the toner is scooped up on the developing roller 13*a* together with carrier by a developer scooping pole generated on the developing roller 13*a*. The developer borne on the developing roller 13*a* is conveyed in the counterclockwise direction indicated by the arrow in FIG. 2 to a position opposite the doctor blade 13*c*. The doctor blade 13*c* adjusts the amount of the developer on the developing roller 13*a* to a proper amount at the position. Subsequently, the rotation of the sleeve 13*a*2 conveys the developer to a developing area in which the developing roller 13 faces the photoconductor drum 11. Then, the toner in the developer is attracted to the electrostatic latent image formed on the photoconductor drum 11 due to the effect of an electric field generated in the developing area. Thereafter, as the sleeve 13*a*2 rotates, the developer remaining on the developing roller 13*a* reaches above the first conveyance path B1 and is separated from the developing roller 13*a*. The electric field in the developing area is formed by a specified voltage (in other words, a development bias) applied to the developing roller 13*a* by a development power supply and a surface potential (in other words, a latent image potential) formed on the photoconductor drum 11 in the charging process and the exposure process.

The toner in the toner container 70 is supplied through the toner supply inlet 13*d* to the developing device 13 as the toner in the developing device 13 is consumed. The toner consumption in the developing device 13 is detected by a toner concentration sensor that magnetically detects a toner concentration in the developer (i.e., a ratio of toner to the developer) in the developing device 13. The toner supply inlet 13*d* is disposed above an end of the second conveying screw 13*b*2 (the second conveyance path B2) in the longitudinal direction (the left and right direction in FIG. 3).

Figure 4:
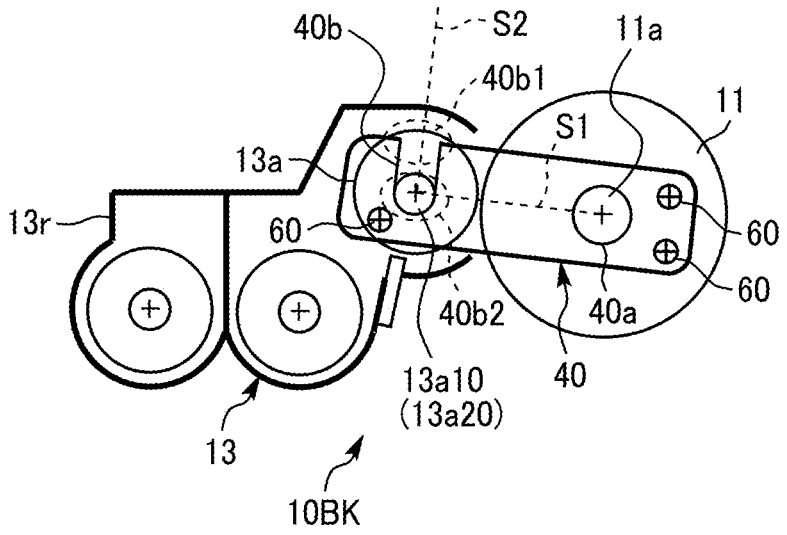
FIG. 4 is a diagram illustrating the process cartridge of FIG. 3 on which a developing device is attached.
Figure 5:
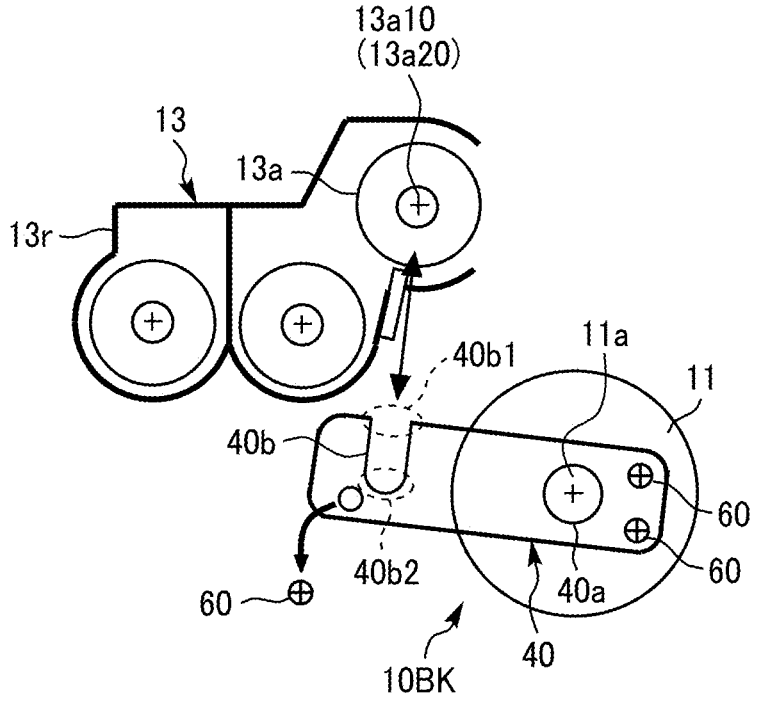
FIG. 5 is a diagram illustrating the process cartridge of FIG. 3 from which the developing device has been detached.

With reference to FIGS. 3 to 5, the configuration and operation of the process cartridge 10BK according to the present embodiment are described in further detail below. As described above with reference to FIGS. 2 and 3, the process cartridge 10BK according to the present embodiment is detachably installed in the main body of the image forming apparatus 1. The process cartridge 10BK includes, for example, the photoconductor drum 11 as a rotatable image bearer and the developing roller 13*a* as a rotatable developer bearer opposite the photoconductor drum 11. The developing roller 13*a* (developer bearer) is rotatably held by the developing device 13. Further, the developing device 13 accommodates the developer inside and is detachably installed with respect to the process cartridge 10BK.

Referring to FIGS. 3 and 4, the process cartridge 10BK in the present embodiment has face plates 40 as positioning members that determine an opposing distance H (or a development gap) between the photoconductor drum 11 and the developing roller 13*a*. The face plates 40 are disposed at both ends of the process cartridge 10BK in the longitudinal direction (rotational axis direction). Each face plate 40 (serving as the positioning member) is formed with a through-hole 40*a* as a fitting portion into which a drum shaft 11*a* as a fitted portion of the photoconductor drum 11 (serving as an image bearer) is rotatably fitted. Further, each face plate 40 is formed with a groove 40*b* (serving as a notch portion) that extends from a ceiling portion 40*b*1 (serving as an upper end portion) to a bottom portion 40*b*2 (serving as a lower end portion) in the vertical direction. A shaft portion 13*a*10 (or 13*a*20) of the developing roller 13*a* (serving as a developer bearer) can slidingly move in the groove 40*b*.

The position of the photoconductor drum 11 (or the drum shaft 11*a*) is determined by the through-holes 40*a*. The position of the developing roller 13*a* (in other words, the positions of the shaft portion 13*a*10 and the shaft portion 13*a*20) is determined by the grooves 40*b*. The developing roller 13*a* is held by the gravity of the developing device 13 so that the shaft portion 13*a*10 (or 13*a*20) closely contacts the bottom portion 40*b*2. Thus, the interaxial distance between the photoconductor drum 11 and the developing roller 13*a* is determined. As a result, the developing gap H (see FIG. 3) is set to a target value with high accuracy. In particular, even if the developing roller 13*a* receives pressure (reaction force) from the developer when the developer borne on the developing roller 13*a* contacts the photoconductor drum 11, the developing gap H does not change, so that a good development process is performed.

Referring to FIG. 3, one of the two face plates 40 (the left face plate in FIG. 3) holds the irrotational shaft portion 13*a*10 (serving as a shaft portion for determining a posture in the rotation direction of the magnet 13*a*1) of the developing roller 13*a*. On the other hand, the other one of the two face plates 40 (the right face plate in FIG. 3) holds a rotatable shaft portion 13*a*20 (serving as a shaft portion for rotating the sleeve 13*a*2) of the developing roller 13*a*. The two face plates 40 have substantially the same configuration except that the two face plates 40 are formed symmetrically with each other.

In the present embodiment, the groove 40*b* of the face plate 40 is formed such that the shaft portion 13*a*10 (or 13*a*20) of the developing roller 13*a* (serving as a developer bearer) contacts and can be held by the bottom portion 40*b*2. The ceiling portion 40*b*1 of the groove 40*b* opens upward such that the shaft portion 13*a*10 (or 13*a*20) can be inserted and removed from the groove 40*b*. That is, the bottom portion 40*b*2 (lower end portion) of the groove 40*b* has a curved wall (having an inner peripheral surface of substantially the same diameter as the outer peripheral surface of the shaft portion 13*a*10 or 13*a*20) that a lower peripheral surface of the shaft portion 13*a*10 (or 13*a*20) contacts. On the other hand, the ceiling portion 40*b*1 (upper end portion) of the groove 40*b* does not have a wall that the shaft portion 13*a*10 (or 13*a*20) contacts. The ceiling portion 40*b*1 is open upward across the entire groove width of the groove 40*b*. Such a configuration allows the shaft portion 13*a*10 (or 13*a*20) to be moved in the direction of a double-headed arrow in FIG. 5 and inserted into the groove 40*b* from the ceiling portion 40*b*1 or separated from the groove 40*b*. Further, such a configuration allows the shaft portion 13*a*10 (or 13*a*20) to be (slidingly) moved along the groove 40*b* in the direction of the double-headed arrow in FIG. 5.

Forming the groove 40*b* on the face plate 40 in this way can reduce time and labor involved in the maintenance and replacement of the developing roller 13*a* as compared with the case where a positioning hole is formed instead of the groove 40*b*. Specifically, when the developing roller 13*a* (or the developing device 13) is maintained or replaced, the developing roller 13*a* (or the developing device 13) can be attached to and detached from the face plates 40 in the state in which the photoconductor drum 11 is fitted to the face plates 40, without taking time and labor to release the fitting between the photoconductor drum 11 and the face plates 40.

Referring to FIGS. 3 and 4, in the present embodiment, the face plates 40 as the positioning member are detachably coupled to a developing case 13*r* of the developing device 13 and a cartridge case 50 (by screw fastening in the present embodiment). The cartridge case 50 is a housing of the process cartridge 10BK different from the developing case 13*r* and holds the charging device 12 and the cleaning device 15 in addition to the photoconductor drum 11. The developing case 13*r* holds the first conveying screw 13*b*1, the second conveying screw 13*b*2, and the doctor blade 13*c* in addition to the developing roller 13*a*.

Specifically, each face plate 40 has three screw through-holes into which screws 60 can be inserted. One female screw portion is formed on each side face of the developing case 13*r*. Two female screw portions are formed on each side face of the cartridge case 50. One of the screws 60 is screwed into the one female screw portion of each side plate of the developing case 13*r* via one of the screw through-holes of the face plate 40. The other two of the screws 60 are screwed into the other two of the female screw portions of each side plate of the cartridge case 50. Accordingly, as illustrated in FIGS. 3 and 4, in the process cartridge 10BK, the developing device 13 is joined via the face plates 40 and integrated as one unit. Further, the interaxial distance between the photoconductor drum 11 and the developing roller 13*a* is determined by the face plates 40. Thus, the developing gap H (see FIG. 3) is set to a target value with high accuracy.

The developing device 13 is detachable and attachable together with the developing roller 13*a* with respect to the face plate 40 in a state of being coupled to the cartridge case 50 (a state in which two screws 60 are screwed together) by moving the shaft portion 13*a*10 (or 13*a*20) of the developing roller 13*a* between the ceiling portion 40*b*1 and the bottom portion 40*b*2 in a state where the face plate 40 is released from the developing case 13*r* (a state in which one screw 60 is removed).

Specifically, as illustrated in FIG. 4, in order to perform maintenance or replacement of the developing device 13, the developing device 13 is removed from the process cartridge 10BK to which the developing device 13 is coupled by the screws 60 via the face plates 40. In this case, first, the process cartridge 10BK is removed from the main body of the image forming apparatus 1. In the removed process cartridge 10BK, the screws 60 (one of which is attached on each of the two face plates 40 at both ends) for coupling the developing device 13 are removed. At this time, the photoconductor drum 11 is still coupled to the cartridge case 50 by the two face plates 40 with the screws 60. As illustrated in FIG. 5, the developing device 13 in the state where the screws are released from the face plate 40 is moved upward along the groove 40*b* of the face plate 40. Then, the developing device 13 is removed from the process cartridge 10BK. Specifically, the shaft portion 13*a*10 and the shaft portion 13*a*20 of the developing roller 13*a* are moved upward along the grooves 40*b*. Then, the developing device 13 is removed from the process cartridge 10BK. At this time, in the process cartridge 10BK, the components (the photoconductor drum 11, the charging device 12, and the cleaning device 15) other than the developing device 13 remain held in the cartridge case 50. When the developing device 13 is attached to the process cartridge 10BK, an operation is performed in the reverse procedure of the above-described detachment procedure.

Forming the groove 40*b* on the face plate 40 in this way can reduce time and labor involved in the maintenance and replacement of the developing device 13 as compared with the case where a positioning hole is formed instead of the groove 40*b*. Specifically, when the developing device 13 is maintained or replaced, the developing device 13 can be attached to and detached from the face plates 40, without taking time and labor to release the fitting between the photoconductor drum 11 and the face plates 40.

Referring to FIG. 4, in the present embodiment, the groove 40*b* of the face plate 40 extends in a direction (indicated by a broken line S2 in FIG. 4) orthogonal to a virtual line S1 connecting the rotation center of the photoconductor drum 11 (serving as an image bearer) and the rotation center of the developing roller 13*a* (serving as a developer bearer). With such a configuration, even if the developing roller 13*a* receives a force in a direction away from the photoconductor drum 11 (a force along the virtual line S1), there is a wall portion that receives the force in the groove 40*b* (e.g., the bottom portion 40*b*2). Thus, even if the developing roller 13*a* receives a force in the direction away from the photoconductor drum 11, the developing gap H is less likely to change.

As illustrated in FIG. 4, in the present embodiment, the rotation center of the photoconductor drum 11 is disposed below the rotation center of the developing roller 13*a*. With this configuration, the above-described virtual line S1 is inclined upward toward the left side of FIG. 4. Thus, the virtual line S2 is inclined clockwise in FIG. 4 with respect to a perpendicular line passing through the intersection with the virtual line S1. That is, the groove 40*b* is inclined in the direction approaching the photoconductor drum 11. Thus, even if the developing roller 13*a* receives a force in the direction away from the photoconductor drum 11, the shaft portion 13*a*10 (or 13*a*20) is less likely to move upward from the bottom portion 40*b*2. Thus, the developing gap H is less likely to change.

First Variation

Figure 6:
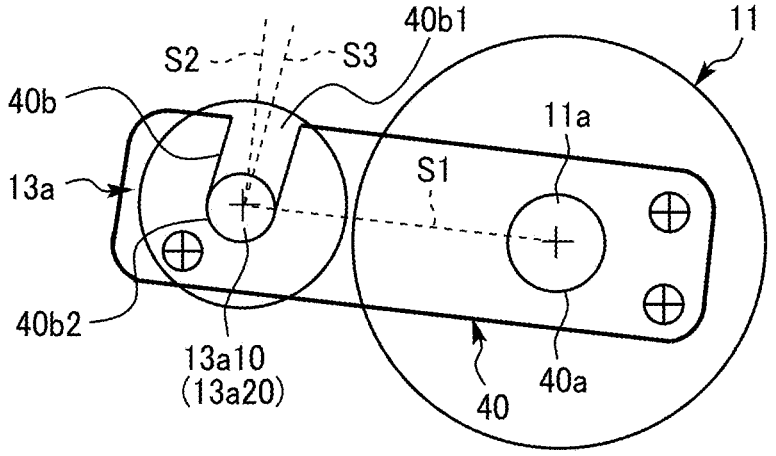
FIG. 6 is an enlarged view of the vicinity of a positioning member in a process cartridge according to a first variation.

As illustrated in FIG. 6, in a face plate 40 (serving as a positioning member) in the first variation, a groove 40*b* of the face plate 40 extends in a direction to incline (a direction indicated by a virtual line S3 in FIG. 6) toward the photoconductor drum 11 with respect to a direction (indicated by a virtual line S2 in FIG. 6) orthogonal to a virtual line S1 connecting the rotation center of the photoconductor drum 11 and the rotation center of the developing roller 13*a*. Specifically, the virtual line S1 is inclined upward toward the left side of FIG. 6. Thus, the virtual line S2 orthogonal to the virtual line S1 is inclined clockwise in FIG. 6 with respect to a perpendicular line passing through the intersection with the virtual line S1. The groove 40*b* extends along the direction of the virtual line S3, which is further inclined in the clockwise direction of FIG. 6 around the intersection described above, than the virtual line S2. With such a configuration, even if the developing roller 13*a* receives a force in a direction away from the photoconductor drum 11 (a force along the virtual line S1), the groove 40*b* (bottom portion 40*b*2) has a wall portion that receives the force in a wider range. Thus, even if the developing roller 13*a* receives a force in the direction away from the photoconductor drum 11, the developing gap H is less likely to change.

Second Variation

Figure 7:
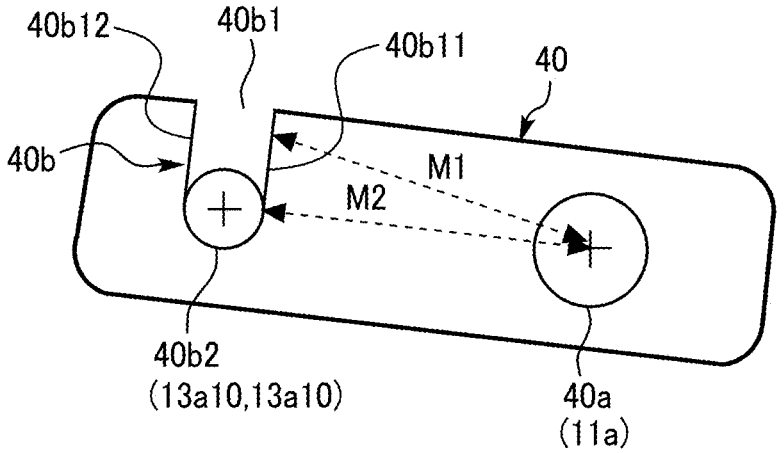
FIG. 7 is an enlarged view of the positioning member in a process cartridge according to a second variation.

As illustrated in FIG. 7, a face plate 40 (serving as a positioning member) in the second variation has a groove 40*b* formed such that two face portions 40*b*11 and 40*b*12 sandwich the shaft portion 13*a*10 (or 13*a*20) of the developing roller 13*a*. At least the face portion 40*b*11 closer to the photoconductor drum 11 is formed such that a portion of the face portion 40*b*11 closer to the bottom portion 40*b*2 is closer to the rotation center of the photoconductor drum 11 than another portion of the face portion 40*b*11 closer to the ceiling portion 40*b*1. Specifically, the face portion 40*b*11 closer to the photoconductor drum 11 than the face portion 40*b*12 has a shorter distance M2 from the rotation center of the photoconductor drum 11 at the bottom portion 40*b*2 than a distance M1 from the rotation center of the photoconductor drum 11 at the ceiling portion 40*b*1 (M1>M2). The face portion 40*b*12 farther from the photoconductor drum 11 than the face portion 40*b*11 is formed to be substantially parallel to the face portion 40*b*11 closer to the photoconductor drum 11 (such that the groove width is substantially constant). With this configuration, when the developing roller 13*a* (developing device 13) is attached to or detached from the process cartridge 10BK, the problem that the developing roller 13*a* (developing device 13) interferes with the photoconductor drum 11 is unlikely to occur.

Third Variation

Figure 8:
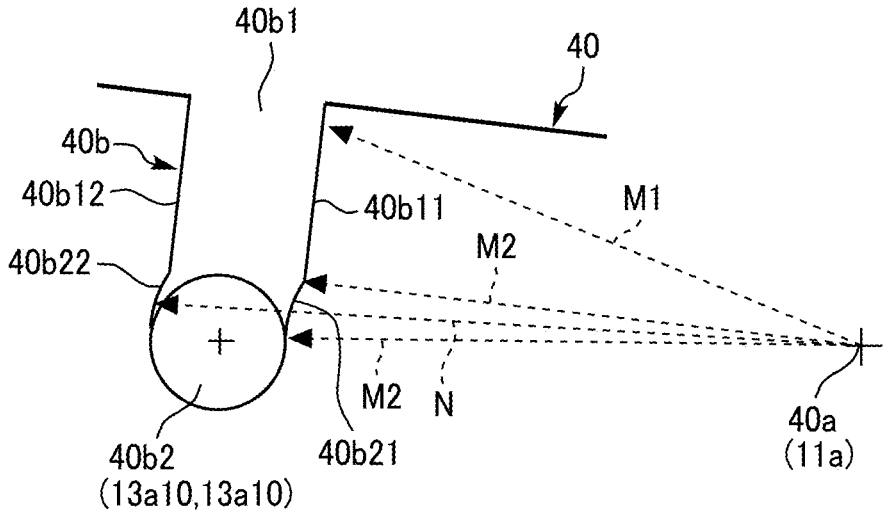
FIG. 8 is an enlarged view of a main part of a positioning member according to a third variation.

As illustrated in FIG. 8, a face plate 40 (serving as a positioning member) in the third variation has a groove 40*b* formed such that two face portions 40*b*11 and 40*b*12 sandwich the shaft portion 13*a*10 (or 13*a*20) of the developing roller 13*a*. The distance M2 from the center of rotation of the photoconductor drum 11 to the face portion 40*b*11 is constant at a part of the bottom portion 40*b*2 and in the vicinity of the bottom portion 40*b*2. The distance N from the center of rotation of the photoconductor drum 11 to the face portion 40*b*12 is constant at a part of the bottom portion 40*b*2 and in the vicinity of the bottom portion 40*b*2. Specifically, the two face portions 40*b*11 and 40*b*12 have R-shaped face portions 40*b*21 and 40*b*22 formed at lower portions of the two face portions 40*b*11 and 40*b*12 (in other words, at a part of the bottom portion 40*b*2 and in the vicinity of the bottom portion 40*b*2). The R-shaped face portion 40*b*21 is formed in a curved-shape such that the distance M2 from the rotation center of the photoconductor drum 11 (in other words, the center of the through-hole 40*a*) is constant. The R-shaped face portion 40*b*22 is formed in a curved-shape such that the distance N from the rotation center of the photoconductor drum 11 (in other words, the center of the through-hole 40*a*) is constant. The difference between the distance N from the rotation center of the photoconductor drum 11 to the R-shaped face portion 40*b*22 farther from the photoconductor drum 11 and the distance M2 from the rotation center of the photoconductor drum 11 to the R-shaped face portion 40*b*21 closer to the photoconductor drum 11 is approximately equal to the outer diameter of the shaft portion 13*a*10 (or 13*a*20). With this configuration, even if the shaft portion 13*a*10 (or 13*a*20) is held so as to float up from the bottom portion 40*b*2 due to adhered substance such as toner to a lower face of the shaft portion 13*a*10 (or 13*a*20), the shaft portion 13*a*10 (or 13*a*20) is held by the R-shaped face portions 40*b*21 and 40*b*22. Thus, the developing gap H between the developing roller 13*a* and the photoconductor drum 11 is less likely to change.

Fourth Variation

Figure 9:
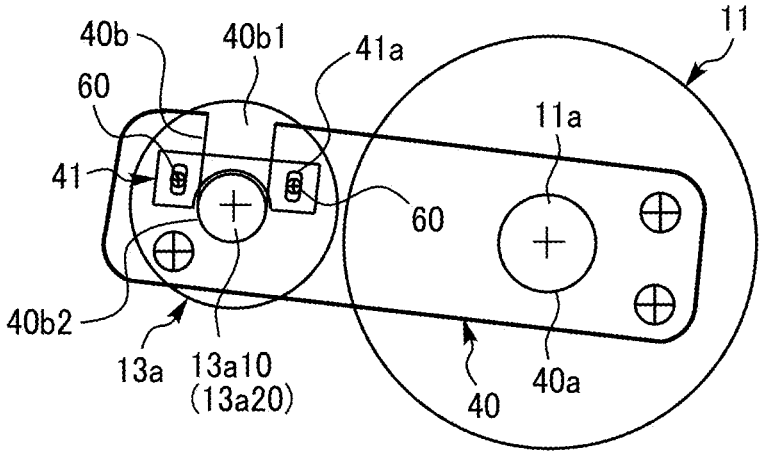
FIG. 9 is an enlarged view of the vicinity of a positioning member in a process cartridge according to a fourth variation.

As illustrated in FIG. 9, the process cartridge 10BK in the fourth variation includes a stopper 41 (serving as a restricting member) that restricts the upward movement of the shaft portion 13*a*10 (or 13*a*20) held in a bottom portion 40*b*2 of a groove 40*b* in a face plate 40. The stopper 41 is detachably attached with respect to the face plate 40. Specifically, the stopper 41 (restricting member) is a plate-shaped member whose lower portion (a portion that contacts the shaft portions 13*a*10 and 13*a*20) is formed in a curved concave shape. The stopper 41 has elongated holes 41*a* whose longitudinal direction is the same as the direction in which the groove 40*b* extends. Further, female screw portions are formed on the face plate 40. The stopper 41 is positioned and set to cover an upper portion of the shaft portion 13*a*10 (or 13*a*20) held by the bottom portion 40*b*2. The stopper 41 is fixed to the face plate 40 so that screws 60 are screwed into the female screw portions of the face plate 40 via the elongated holes 41*a*. With such a configuration, even if a force that lifts the developing roller 13*a* (or the developing device 13) acts upward, the shaft portion 13*a*10 (or 13*a*20) held by the bottom portion 40*b*2 in the groove 40*b* is restricted by the stopper 41, and does not separate from the bottom 40*b*2 so as to float up from the bottom 40*b*2. Thus, the developing gap H between the developing roller 13*a* and the photoconductor drum 11 is less likely to change. In the fourth variation, the stopper 41 may be formed to press the shaft portion 13*a*10 (or 13*a*20) from above. The shape of the stopper 41 and the way of installing the stopper 41 on the face plate 40 are not limited to those described above. The stopper 41 may be formed in a lid shape to close the ceiling portion 40*b*1 (opening) of the groove 40*b*.

As described above, the process cartridge 10BK in the present embodiment is detachably disposed with respect to the main body of the image forming apparatus 1. The process cartridge 10BK includes the rotatable photoconductor drum 11 (serving as an image bearer), the rotatable developing roller 13*a* (serving as a developer bearer) opposing the photoconductor drum 11, and the face plates 40 (serving as a positioning member) to determine the opposing distance H between the photoconductor drum 11 and the developing roller 13*a*. The face plate 40 (serving as a positioning member) has the through-hole 40*a* (serving as a fitting portion) and the groove 40*b*. The drum shaft 11*a* (serving as a fitted portion) of the photoconductor drum 11 is rotatably fitted to the through-hole 40*a*. The groove 40*b* is formed to extend vertically from the ceiling portion 40*b*1 to the bottom portion 40*b*2. The shaft portion 13*a*10 (or 13*a*20) of the developing roller 13*a* can slidingly move on the groove 40*b*. The groove 40*b* is formed so that the shaft portion 13*a*10 (or 13*a*20) of the developing roller 13*a* can be held abutting to the bottom portion 40*b*2. The ceiling portion 40*b*1 of the groove 40*b* is open upward so that the shaft portion 13*a*10 (or 13*a*20) of the developing roller 13*a* can be inserted to and removed from the groove 40*b*. Such a configuration can reduce the time and labor involved in maintenance and replacement of the developing roller 13*a* (or the developing device 13).

In the present embodiment, the through-hole 40*a* as the fitting portion of the face plate 40 (serving as a positioning member) is fitted to the drum shaft 11*a* as the fitted portion of the photoconductor drum 11 (serving as an image bearer). However, the combination of the fitted portion of the image bearer and the fitting portion of the positioning member is not limited to this. For example, a convex member as a fitting portion of the face plate 40 (serving as a positioning member) may fit to a concave flange as a fitted portion of the photoconductor drum 11 (serving as an image bearer). In the present embodiment, the through-hole 40*a* and the groove 40*b* of the face plate 40 are formed so that the drum shaft 11*a* and the shaft portions 13*a*10 and 13*a*20 penetrate, respectively. On the other hand, at least one of the through-hole 40*a* and the groove 40*b* in the face plate 40 may be formed so that the drum shaft 11*a* and the shaft portions 13*a*10 and 13*a*20 do not penetrate and the outer side of the at least one of the through-hole 40*a* and the groove 40*b* in the rotation axis direction is closed. Such cases also provide substantially the same effects as the effects described above.

In the present embodiment, the process cartridge 10BK includes the photoconductor drum 11 (serving as an image bearer), the developing device 13, the charging device 12, and the cleaning device 15. However, a process cartridge according to an embodiment of the present disclosure is not limited to the above-described process cartridge may be any other type of process cartridge as long as the process cartridge includes at least a photoconductor drum (image bearer) and a developing device (developer bearer). Such cases can also provide substantially the same effects as the effects described above. It is to be noted that the term "process cartridge" used in the present disclosure means a removable unit including an image bearer and at least one of a charging device to charge the image bearer, a developing device to develop a latent image on the image bearer, and a cleaning device to clean the image bearer that are united together, and is designed to be detachably installed as a united part in the body of the image forming apparatus.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. Further, the number, position, shape, and the like, of components are not limited to those of the present embodiment, and may be the number, position, shape, and the like, that are suitable for implementing the present disclosure.

The invention claimed is:

1. A process cartridge comprising:

an image bearer that is rotatable;

a developer bearer that is rotatable and opposite to the image bearer; and a positioner configured to determine an opposing distance between the image bearer and the developer bearer, the positioner including:

a fitting portion to which a fitted portion of the image bearer rotatably fits; and a groove that extends from a ceiling portion to a bottom portion and in which a shaft portion of the developer bearer is slidingly movable, wherein the shaft portion of the developer bearer contacts the bottom portion and is supported by the bottom portion due to the groove, wherein the ceiling portion of the groove is open upward so that the shaft portion of the developer bearer is insertable to and removable from the groove, wherein there is a gap between a surface of the developer bearer and a surface of the image bearer, and wherein the groove has a curved surface, in which a distance from a rotation center of the image bearer to the curved surface is constant, at a part of the bottom portion so that the gap is constant at the part of the bottom portion.

2. The process cartridge according to claim 1, further comprising:

a developing structure accommodating developer inside and including a developing case; and a cartridge case different from the developing case, wherein the developing structure is detachably installed in the process cartridge, wherein the developer bearer is rotatably held in the developing structure, wherein the positioner is detachably coupled to the developing case and the cartridge case, and wherein the developing structure, together with the developer bearer, is attachable to and detachable from the positioner coupled to the cartridge case by movement of the shaft portion of the developer bearer between the ceiling portion and the bottom portion while coupling of the positioner with the developing case is released.

3. The process cartridge according to claim 2, wherein the positioner is detachably coupled to the developing case.

4. The process cartridge according to claim 1, wherein the groove extends in a direction inclined toward the image bearer with respect to a direction orthogonal to a virtual line connecting a rotation center of the image bearer and a rotation center of the developer bearer.

5. The process cartridge according to claim 1, wherein the groove includes two face portions facing each other across the shaft portion of the developer bearer, wherein the two face portions include one face portion closer to the image bearer than the other face portion, and wherein at least the one face portion closer to the image bearer is formed such that a part of the one face portion closer to the bottom portion is closer to the rotation center of the image bearer than another part of the one face portion closer to the ceiling portion.

6. The process cartridge according to claim 5, wherein the distance from the rotation center of the image bearer to the one face portion closer to the image bearer is constant at the part of the bottom portion.

7. The process cartridge according to claim 1, further comprising a restrictor to restrict an upward movement of the shaft portion supported by the bottom portion of the groove, wherein the restrictor is detachably attached with respect to the positioner.

8. The process cartridge according to claim 1, wherein the rotation center of the image bearer is disposed below a rotation center of the developer bearer when the process cartridge is in an installed orientation within an image forming apparatus which is in an upright orientation.

9. An image forming apparatus comprising:

a main body; and the process cartridge according to claim 1, wherein the process cartridge is detachably attached with respect to the main body.

10. A process cartridge comprising:

an image bearer that is rotatable;

a developer bearer that is rotatable and opposite to the image bearer; and a positioner configured to determine an opposing distance between the image bearer and the developer bearer, the positioner including:

a fitting portion to which a fitted portion of the image bearer rotatably fits; and a groove that extends from a ceiling portion to a bottom portion and in which a shaft portion of the developer bearer is slidingly movable;

wherein the shaft portion of the developer bearer contacts the bottom portion and is supported by the bottom portion due to the groove, wherein the ceiling portion of the groove is open upward so that the shaft portion of the developer bearer is insertable to and removable from the groove, wherein there is a gap between a surface of the developer bearer and a surface of the image bearer, and wherein the groove guides a structure including the developer bearer in a direction orthogonal to a virtual line connecting a rotation center of the image bearer and a rotation center of the developer bearer.

11. A process cartridge comprising:

an image bearer that is rotatable;

a developer bearer that is rotatable and opposite to the image bearer; and a positioner configured to determine an opposing distance between the image bearer and the developer bearer, the positioner including:

a fitting portion to which a fitted portion of the image bearer rotatably fits; and a groove that extends from a ceiling portion to a bottom portion and in which a shaft portion of the developer bearer is slidingly movable, wherein the shaft portion of the developer bearer contacts the bottom portion and is supported by the bottom portion due to the groove, wherein the ceiling portion of the groove is open upward so that the shaft portion of the developer bearer is insertable to and removable from the groove, and wherein the groove guides a structure including the developer bearer in a direction orthogonal to a virtual line connecting a rotation center of the image bearer and a rotation center of the developer bearer.

12. The process cartridge according to claim 11, further comprising:

a developing structure accommodating developer inside and including a developing case; and a cartridge case different from the developing case, wherein the developing structure is detachably installed in the process cartridge, wherein the developer bearer is rotatably held in the developing structure, wherein the positioner is detachably coupled to the developing case and the cartridge case, and wherein the developing structure, together with the developer bearer, is attachable to and detachable from the positioner coupled to the cartridge case by movement of the shaft portion of the developer bearer between the ceiling portion and the bottom portion while coupling of the positioner with the developing case is released.

13. The process cartridge according to claim 12, wherein the positioner is detachably coupled to the developing case.

14. The process cartridge according to claim 11, wherein the groove includes two face portions facing each other across the shaft portion of the developer bearer, wherein the two face portions include one face portion closer to the image bearer than the other face portion, and wherein at least the one face portion closer to the image bearer is formed such that a part of the one face portion closer to the bottom portion is closer to the rotation center of the image bearer than another part of the one face portion closer to the ceiling portion.

15. The process cartridge according to claim 14, wherein a distance from the rotation center of the image bearer to the one face portion closer to the image bearer is constant at a part of the bottom portion.

16. The process cartridge according to claim 11, wherein the groove includes two face portions facing each other across the shaft portion of the developer bearer, and wherein a distance from the rotation center of the image bearer to any one of the two face portions is constant at a part of the bottom portion.

17. The process cartridge according to claim 11, further comprising:

a restrictor to restrict an upward movement of the shaft portion supported by the bottom portion of the groove, wherein the restrictor is detachably attached with respect to the positioner.

18. The process cartridge according to claim 11, wherein:

the rotation center of the image bearer is disposed below the rotation center of the developer bearer when the process cartridge is in an installed orientation within an image forming apparatus which is in an upright orientation.

19. An image forming apparatus comprising:

a main body; and the process cartridge according to claim 11, wherein the process cartridge is detachably attached with respect to the main body.

* * * * *